US007572138B1

(12) United States Patent
Wu

(10) Patent No.: US 7,572,138 B1
(45) Date of Patent: Aug. 11, 2009

(54) PLUG CONNECTOR HAVING A LATCHING MECHANISM

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/214,672

(22) Filed: Jun. 20, 2008

(51) Int. Cl.
*H01R 13/62* (2006.01)

(52) U.S. Cl. ..... 439/352

(58) Field of Classification Search ..... 439/352, 439/350, 351, 353–358
See application file for complete search history.

(56) References Cited

U.S. PATENT DOCUMENTS 5,564,939 A 10/1996 Maitani et al.
5,797,771 A 8/1998 Garside
6,077,101 A * 6/2000 Garretson et al. ..... 439/352
6,165,006 A 12/2000 Yeh et al.
6,648,665 B1 11/2003 Wu
6,659,790 B1 12/2003 Wu
6,749,458 B1 6/2004 Kuo et al.
6,866,533 B2 3/2005 Wu
6,887,091 B1 5/2005 Wu
6,887,101 B2 5/2005 Ito et al.
7,445,484 B2 * 11/2008 Wu ..... 439/352
7,467,117 B2 * 12/2008 Kermani ..... 706/20
7,473,124 B1 * 1/2009 Briant et al. ..... 439/352
2006/0189197 A1 * 8/2006 Reed et al. ..... 439/352
2007/0161281 A1 * 7/2007 Wu ..... 439/352
2008/0032541 A1 * 2/2008 Reed et al. ..... 439/352

OTHER PUBLICATIONS

"SFF-8088 Specification for Compact Multilane Series: Shielded" published on Jun. 27, 2005 by SFF Committee.

* cited by examiner

*Primary Examiner*—Gary F. Paumen
(74) *Attorney, Agent, or Firm*—Wei Te Chung

(57) ABSTRACT

A plug connector (100) mating with a complementary connector includes a housing (1), a circuit board (7), a latching mechanism (20) and a metal shell (5). The latching mechanism includes a pusher (3) having a pivot (32), a puller (4) connected with the pusher and having a resisting portion (430), and a latch (2) having an inclined connecting portion (23) engagable with the resisting portion and a pair of claws (222). The metal shell has a pair of resilient beams (52) for resisting against the latching mechanism. The pusher is pivotable about the pivot to move the resisting portion relative to the inclined connecting portion, to thereby move the claws from a latching position to an unlatching position.

20 Claims, 6 Drawing Sheets

PLUG CONNECTOR HAVING A LATCHING MECHANISM

CROSS-REFERENCE TO RELATED APPLICATIONS

This patent application is related to a copending U.S. patent application entitled "PLUG CONNECTOR HAVING A LATCHING MECHANISM", which is invented by the same inventor as this patent application and assigned to the same assignee with this application.

BACKGROUND OF THE INVENTION

1. Field of the Invention

The present invention generally relates to a plug connector, and more particularly to a plug connector used for high-speed signal transmission.

2. Description of Related Art

A committee called SFF is an ad hoc group formed to address storage industry needs in a prompt manner. When formed in 1990, the original goals were limited to define de facto mechanical envelopes within disk drives can be developed to fit compact computer and other small products.

Specification SFF-8088 defines matable Compact Multilane Shielded connectors adopted for being used in laptop portable computer to connect small-size disk drives to a circuit board. The connectors comprise a plug connector connecting with the small-size drive and a header mounted on the circuit board. The plug connector defined in the specification comprises a pair of engagable metal housings together defining a receiving space therebetween, a circuit board received in the receiving space, a cable comprising a plurality of conductors electrically connecting with the circuit board, and a latching mechanism assembled to a top surface of the upper metal housing. The latching mechanism comprises an elongated T-shape latch member for latching with the header mentioned above and an actuating member cooperating with the latch member for actuating the latch member to separate from the header. The latch member is assembled to a rear portion of a base of the upper housing with latch portion exposed beyond a front portion of the base of the upper housing to locate above a tongue portion of the upper housing.

However, such elongated latch member is hard to be actuated by the actuating member, otherwise the latch member must have enough thickness or made by high-quality material having enough rigidity to achieve the goal of latching reliably and unlatching easily.

Hence, an improved plug connector is provided in the present invention to address the problems mentioned above and meet the current trend.

BRIEF SUMMARY OF THE INVENTION

Accordingly, an object of the present invention is to provide a plug connector having a latching mechanism for achieving a reliable latching and an easy unlatching.

In order to achieve the above-mentioned object, a plug connector mating with a complementary connector in accordance with the present invention comprises a housing having a base, a circuit board received in the housing, a latching mechanism assembled to the base and a metal shell attached to the base. The latching mechanism includes a pusher having a pivot, a puller pivotally connected with the pusher and having a resisting portion, and a latch having an inclined connecting portion engagable with the resisting portion and a latching portion provided with a pair of claws. The metal shell has a pair of upwardly deformable resilient beams for resisting against the latching mechanism. The pusher is pivotable about the pivot to move the resisting portion relative to the inclined connecting portion of the latch, to thereby move the latching portion together with the claws from a latching position to an unlatching position.

The latching mechanism comprises a pusher, a puller and a latch cooperated together to latch or unlatch the complementary connector, i.e., the puller is slidable to move the latch between the latching and unlatching position, along with a rotation of the pusher. When the pusher is rotated, the puller and the latch would be driven automatically. It is easy to drive the whole latching mechanism, if only depressing the pusher. The claws would latch the complementary connector reliably, since the latch restores itself to the latching position via a resilient restoring force provided by the resilient beams of the metal shell.

Other objects, advantages and novel features of the invention will become more apparent from the following detailed description of the present embodiment when taken in conjunction with the accompanying drawings.

DETAILED DESCRIPTION OF THE INVENTION

Figure 1:
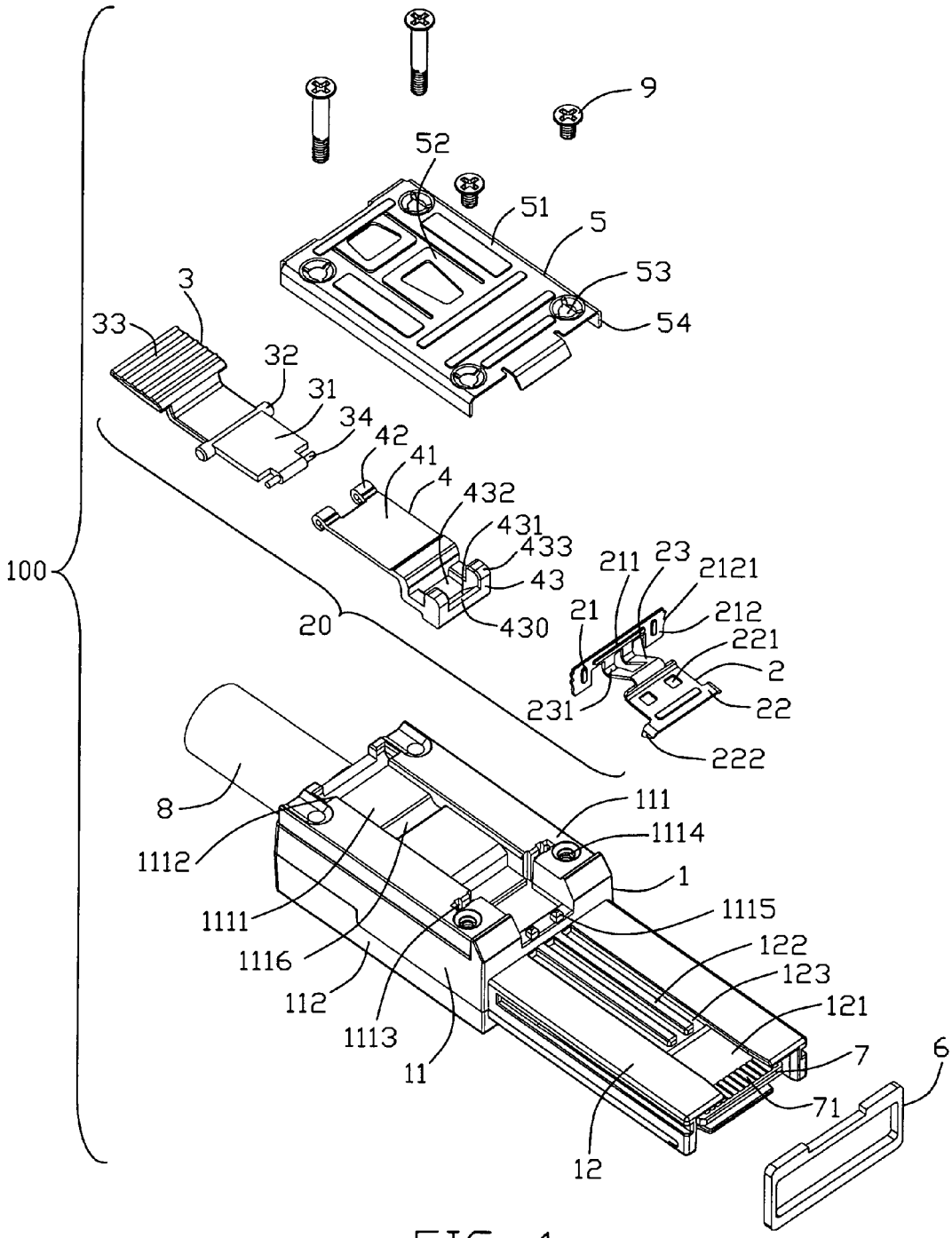
FIG. 1 is an exploded perspective view of a plug connector in accordance with the present invention.

Reference will now be made to the drawing figures to describe the present invention in detail.

Figure 2:
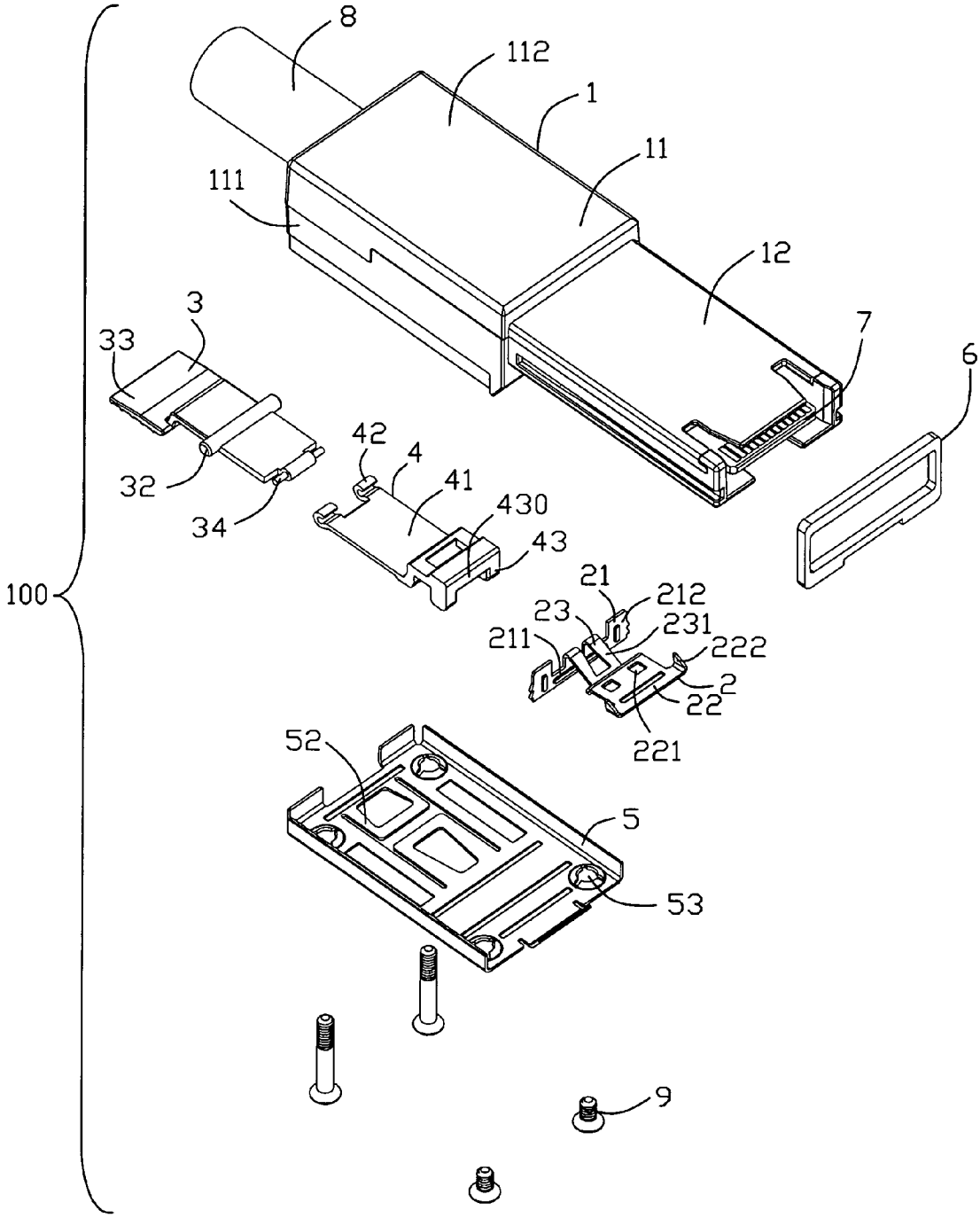
FIG. 2 is a view similar to FIG. 1, taken from another aspect.
Figure 3:
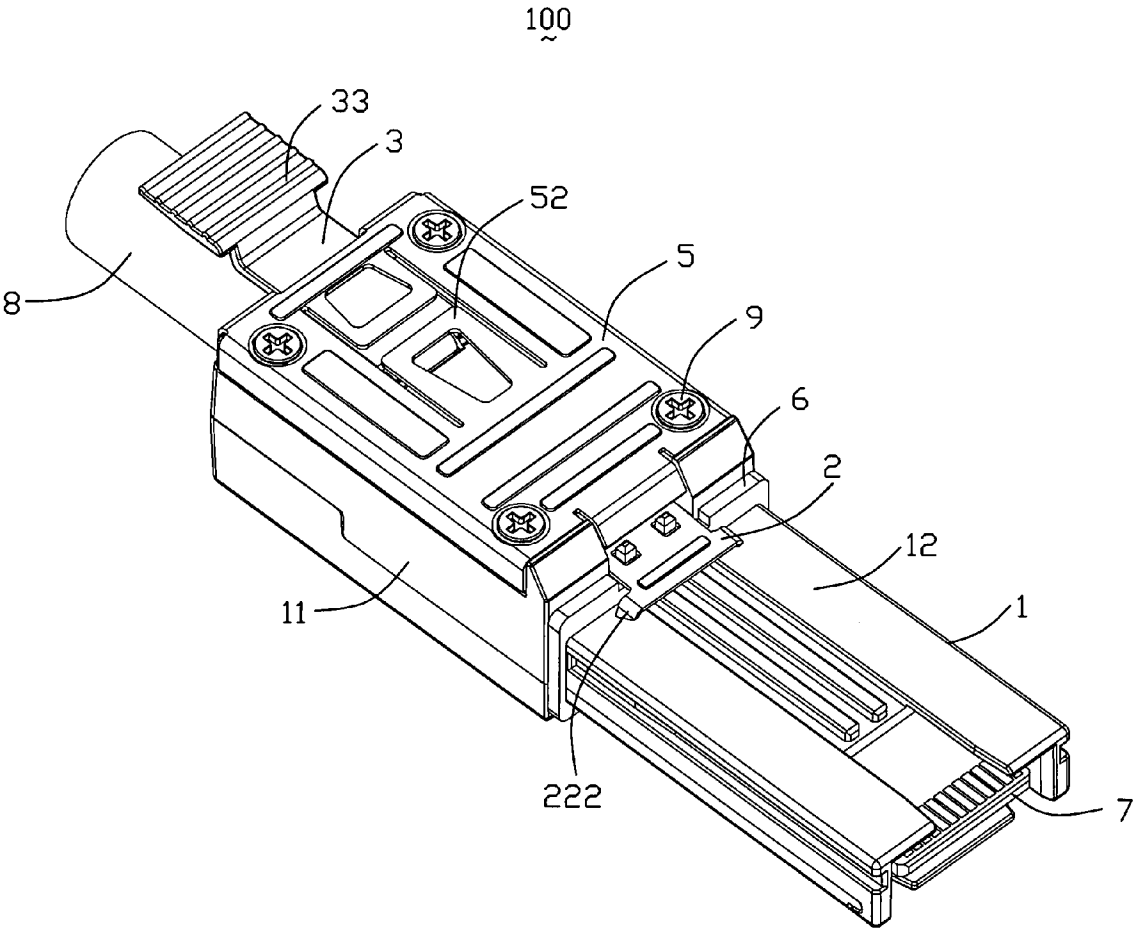
FIG. 3 is an assembled perspective view of the plug connector as shown in FIG. 1.
Figure 4:
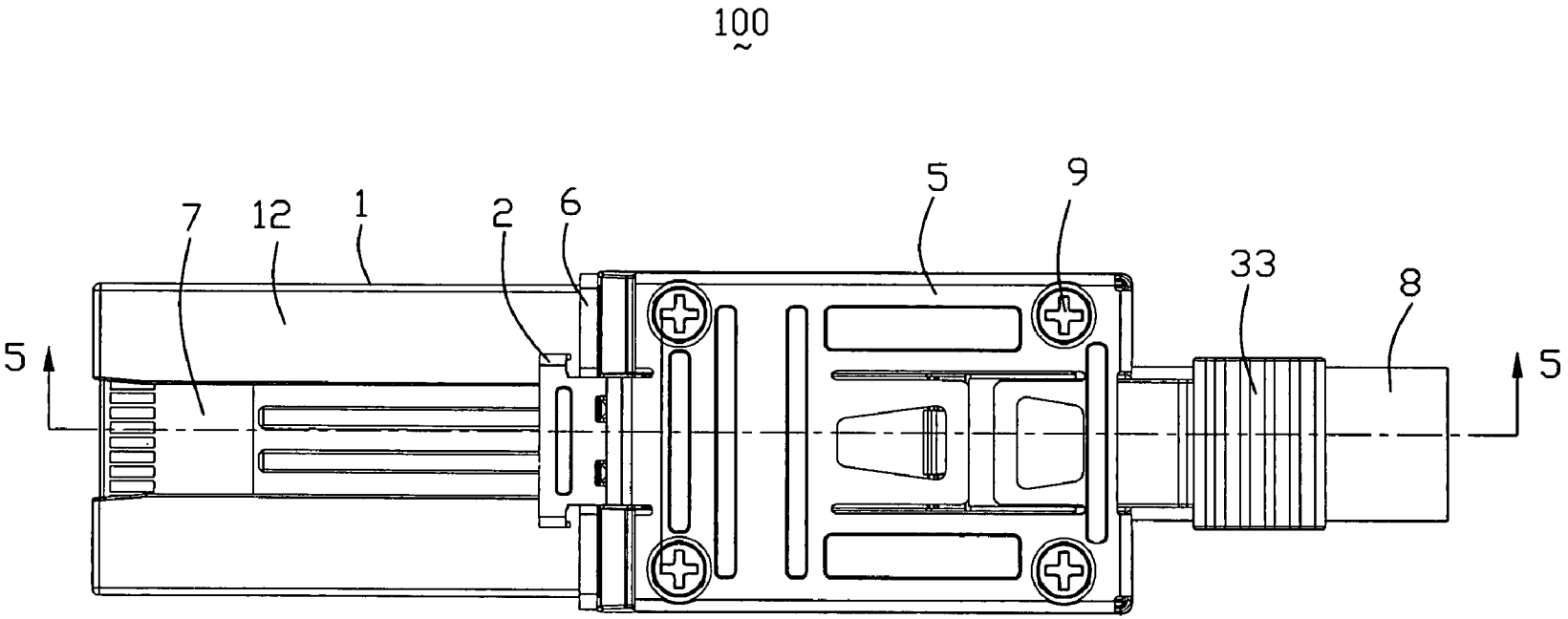
FIG. 4 is an assembled top view of the plug connector as shown in FIG. 3.

Referring to FIGS. 1-3, a plug connector 100 mating with a complimentary connector (not shown) in accordance with the present invention comprises a housing 1, a latching mechanism 20 assembled to the housing 1, an EMI gasket 6 attached to the housing 1, a metal shell 5 partially covering the latching mechanism 20, a plurality of screws 9 fixing the metal shell 5 on the housing 1, a circuit board 7 disposed in the housing 1, and a cable 8 electrically connected to the circuit board 7.

Please referring to FIGS. 1-2, the housing 1 of the present invention comprises a base 11 and an elongated tongue portion 12 extending forwardly from the base 11. The base comprises a lower base 112, an upper base 111 engaging with the lower base 112 and a receiving space (not shown) defined between the upper and lower bases 111, 112 for partially retaining the circuit board 7 and the cable 8. Both upper and lower bases 111 and 112 are preferably die-casted.

The upper base 111 has an elongated receiving slot 1111 extending along an upper surface thereof, a transversely extending engaging groove 1112, an insertion recess 1113 communicating with the receiving slot 1111, a retaining recess 1116 defined between the engaging groove 1112 and the insertion recess 1113, four screw holes 1114 defined at four corners of the upper base 111, and a pair of protruding tabs 1115 formed at a front edge of the receiving slot 1111.

The circuit board 7 is formed with a plurality of conductive pads 71 for electrically connecting with the complementary connector. The tongue portion 12 has a receiving space defined therein for receiving a front portion of the circuit board 7, and an opening 121 defined on an upper surface thereof for exposing the conductive pads 71 of the circuit board 7. The tongue portion 12 has a plurality of flanges 122 formed on an upper surface thereof and a plurality of keyways 123 defined adjacent to the flanges 122.

The latching mechanism 20 comprises a latch 2, a pusher 3 and a puller 4 mounted between the latch 2 and the pusher 3. The latch 2 made of metal material is a cantilever-type member. The latch member 2 comprises a N-shaped engaging portion 21 located in a vertical surface, a flat latching portion 22 located in a horizontal surface perpendicular to the vertical surface and an inclined connecting portion 23 connecting the engaging portion 21 with the latching portion 22 to provide spring force to the latch 2. The engaging portion 21 comprises a transverse bar section 211 and a pair of side sections 212 extending downwardly from opposite sides of the bar section 211. Each side section 212 is formed with a plurality of barbs 2121 on outmost edge thereof. The flat latching portion 22 defines a pair of rectangular holes 221 adjacent to the connecting portion 23, and a pair of claws 222 bending downwardly from opposite sides of the front edge thereof for clasping the complementary connector. The connecting portion 23 comprises a pair of coextensive L-shaped connecting beams 231. The connecting portion 23 also defines a hole therein for adjusting spring force of the latch 2 through changing size and shape of the hole.

The pusher 3 comprises a rectangular body portion 31, a pivot 32 formed at a substantially middle portion of the body portion 31, a rectangular pressing portion 33 formed at a free end of the body portion 31, and an shaft 34 opposite to the pressing portion 33 relative to the pivot 32.

The puller 4 made of plastic material comprises a head portion 43, an intermediate portion 41 bending upwardly and extending away from the head portion 43, a pair of hook portions 42 provided at a free end of the intermediate portion 41. The head portion 43 has a resisting portion 430 formed at a front edge thereof, an inclined face 431 connected to the resisting portion 430, a pair of blocks 433 rising from opposite ends of the resisting portion 430, and an indentations 432 defined in the head portion 43.

The metal shell 5 comprises a top wall 51, a pair of side walls 54 bending downwardly from the top wall 51, a pair of resilient beams 52 formed on the top wall 51. The top wall 51 has four mounting holes 53 defined at four corner portions thereof. The pair of resilient beams 52 respectively has a deformable free end facing toward each other.

Referring to FIGS. 1-3, in assembly of the plug connector 100, the cable 8 is soldered to the circuit board 7. The circuit board 7 together with the cable 8 is partially sandwiched between the upper and lower bases 111, 112. The hook portions 42 of the puller 4 engage with the shaft 34 of the pusher 3 to establish a linkage between the hook portions 42 and the shaft 34. The pusher 3 and the puller 4 are mounted in receiving slot 1111, with the pivot 32 ratatably received in the engaging recess 1112. The shaft 34 and the hook portions 42 are connected with each other via the linkage and are plunged in the retaining recess 1116. The latch 2 is inserted in the receiving slot 111, with the connecting portion 23 plunged in the indentation 432 of the puller 4. In conjunction with FIG. 5, the connection portion 23 is disposed above the resisting portion 430 in a certain distance, with inclined lower surface thereof facing toward the inclined face 431. The side sections 212 are inserted in the insertion recess 1113, and the bar sections 211 together with the connecting portion 23 is restricted from a front-to-back movement. The pair of rectangular holes 221 engage with the pair of protruding tabs 1115.

The EMI gasket 6 is attached to a front face of the base 11 of the housing 1 for shielding purpose. The metal shell 5 is fixed on the housing 1, with each screw 9 inserted through the mounting hole 53 into the screw hole 1114. The latch 2, the puller 4 and the body portion 32 of the pusher 3 are partially covered by the metal shell 5 and the pressing portion 33 is exposed outside the housing 1.

Figure 5:
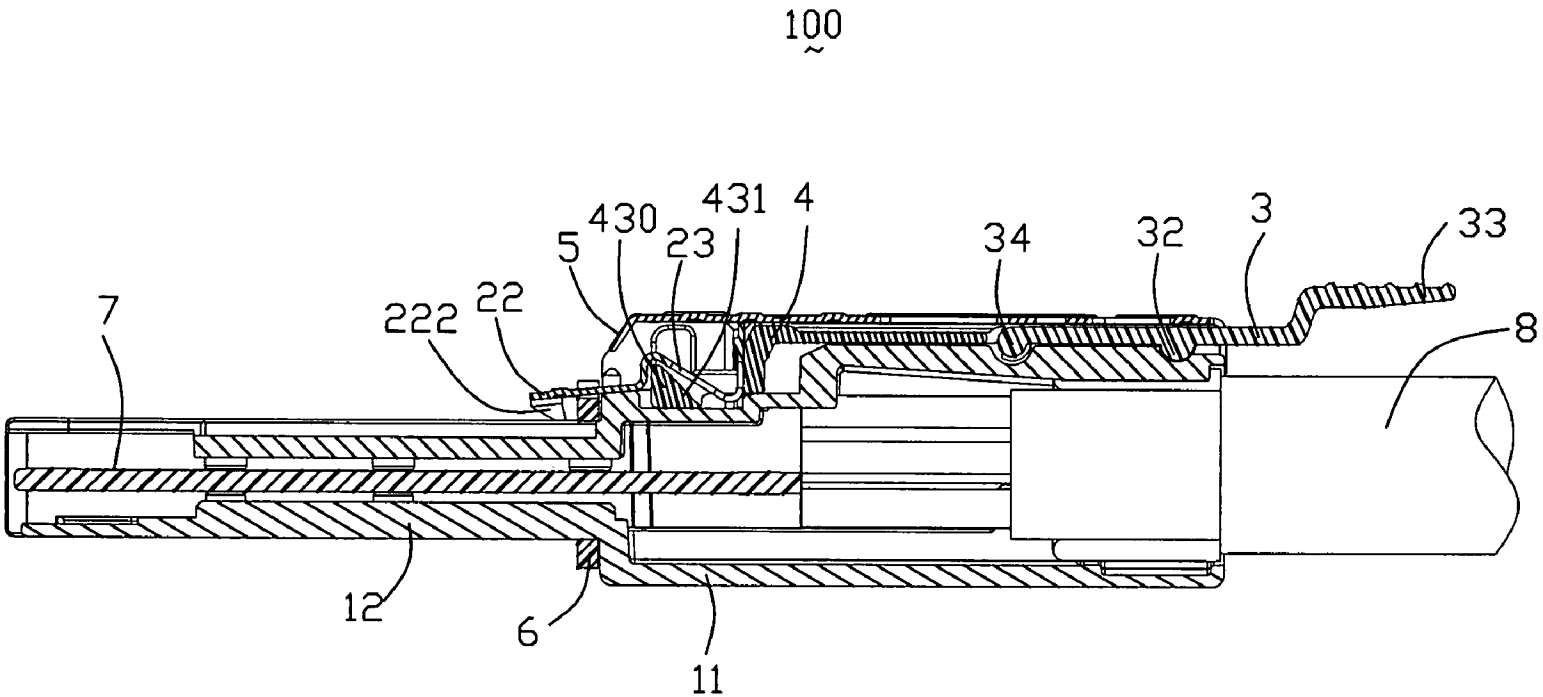
FIG. 5 is a cross-sectional view taken along line 5-5 of FIG. 4, when a latching mechanism is positioned in a latching position.
Figure 6:
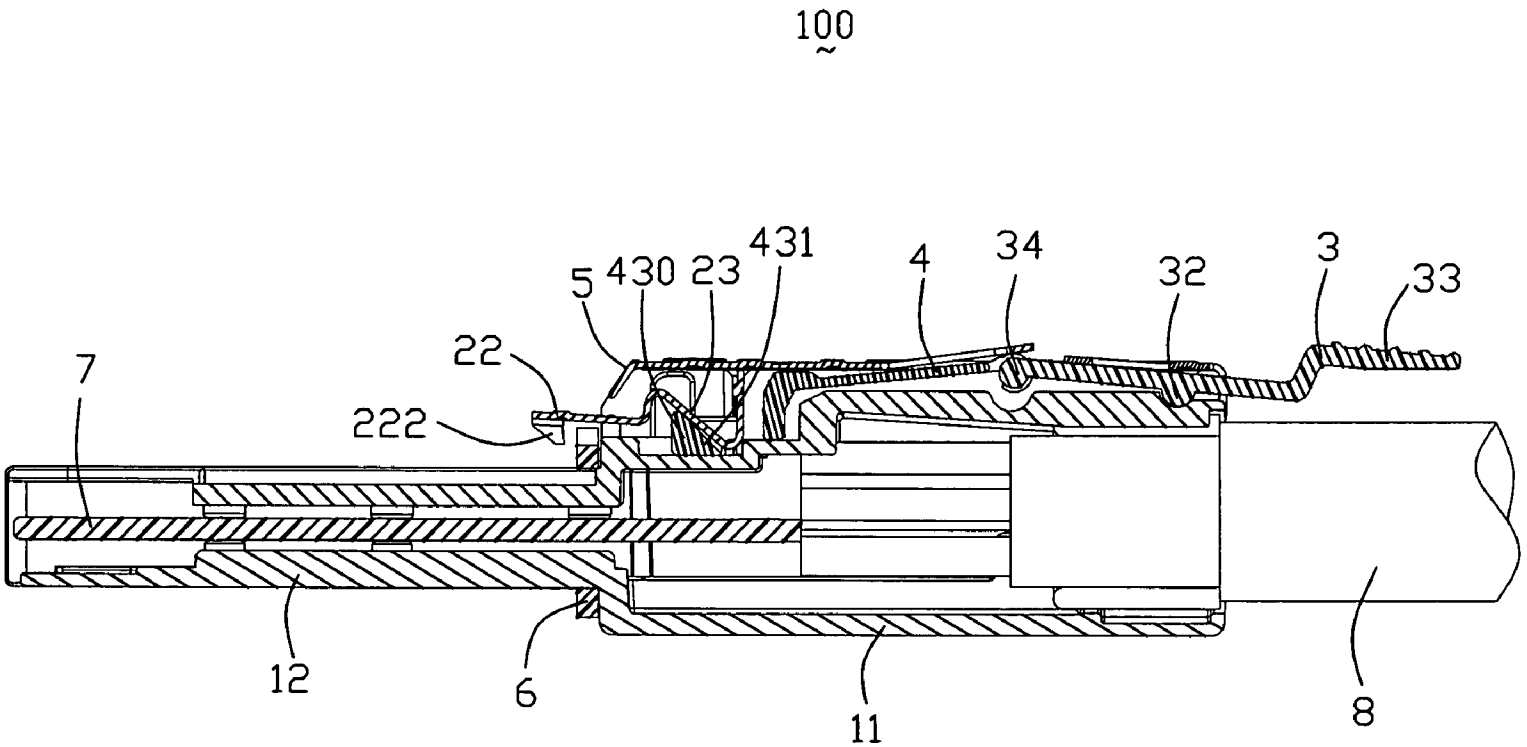
FIG. 6 is a cross-sectional view taken along line 5-5 of FIG. 4, when the latching mechanism is positioned in an unlatching position.

FIG. 5 illustrates the plug connector 100 located in a latching position and FIG. 6 illustrates the plug connector 100 located in an unlatching position. A downward pulling force is exerted to the pressing portion 33 of the pusher 3 to actuate the shaft 34 together with the hook portions 42 rotating upwardly around the pivot 32. The resilient beams 52 of the metal shell 5 are upwardly resisted against by the shaft 34 and the hook portions 42. The head portion 43 of the puller 4 rearwardly retreats along the receiving slot 1111, along with the upward movement of the hook portions 42. Simultaneously, the resisting portion 430 comes to contact with the connecting portion 23 and slides along the inclined connecting portion 23 of the latch 2 to move the connecting portion 23. Since the bar section 212 is restricted from the front-to-back movement by the insertion recess 1113, the connection portions 23 have been upheld by the resisting portion 430. In such a process, the inclined connecting portion 23 is attached to the inclined face 431 of the puller 4 and climbs upwardly along the inclined face 431. At the same time, the latching portion 22 together with the claws 222 move upwardly to the released position.

When the plug connector 100 is located in the unlatching position as shown in FIG. 6, the complementary connector could be mounted onto or removed from the plug connector 100. When the exerted force is released, the resilient beams 52 of the metal shell 5 would provide a resilient restoring force to the shaft 34 and the hook portions 42. The shaft 34 and the hook portions 42 together with the whole latching mechanism 200 revert to the latching position as shown in FIG. 5.

After the downward pressing force is removed from the pressing portion 33, restoring force of the resilient beams 52 drives the shaft 34 and the hook portions 42 to return to the retaining recess 11116. The resisting portion 430 of the puller 4 moves forwardly to its original position, and thus, the latch 2 also reverts to its original position. At this time, the complementary connector electrically connects with the conductive pads 71 of the circuit board 7, with claws 222 clasping corresponding structure of the complementary connector.

latching mechanism 20 comprises a pusher 3, a puller 4 and a latch 2 cooperated together to latch or unlatch the complementary connector. When the pusher 3 is depressed, the puller 4 and the latch 2 would be driven automatically. It is easy to drive the whole latching mechanism 20, if only depressing the pusher 3. The claws 222 would latch the complementary connector reliably, since the latch 2 restores itself to the latching position via the resilient restoring force provided by the resilient beams 52 of the metal shell 5.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A plug connector adapted for mating with a complementary connector, comprising:

a housing comprising a base and a tongue portion extending forwardly from the base for fitting with the complementary connector;

a circuit board received in the housing;

a latching mechanism assembled to the base, said latching mechanism comprising a pusher having a pivot, a puller pivotally connected with the pusher and having a resisting portion, and a latch having an inclined connecting portion engagable with the resisting portion and a latching portion provided with a pair of claws; and a metal shell attached to the base and having a pair of upwardly deformable resilient beams for resisting against the latching mechanism;

wherein said pusher is pivotable about the pivot to move the resisting portion relative to the inclined connecting portion of the latch, to thereby move the latching portion together with the claws from a latching position to an unlatching position.

2. The plug connector as claimed in claim 1, wherein said pusher is formed with a shaft, and wherein said puller has a pair of hook portions engageable with the shaft to establish a linkage between the pusher and the puller and movable along with the shaft.

3. The plug connector as claimed in claim 2, wherein said pusher is formed with a pressing portion opposite to the shaft relative to the pivot and exposed outside of the housing, said shaft together with the hook portions being pivotable upwardly about the pivot when the pressing portion is depressed downwardly.

4. The plug connector as claimed in claim 3, wherein said pair of resilient beams of the metal shell resist against the shaft and the hook portions and provide a resilient restoring force to the shaft and the hook portions.

5. The plug connector as claimed in claim 3, wherein said latch comprises a bar section connected to the connecting portion and having a pair of side sections formed at opposite sides of the bar section, and wherein said base defines a transversely extending insertion recess for insertion of the side sections to restrict the latch from a front-to-back movement.

6. The plug connector as claimed in claim 5, wherein said resisting portion of the puller comes to contact with the inclined connecting portion of the latch and slides along a lower surface of the inclined connecting portion, in response to an upward movement of the linkage between the pusher and the puller.

7. The plug connector as claimed in claim 6, wherein said resisting portion of the puller has an inclined face facing toward the inclined connecting portion of the latch, said connecting portion climbing upwardly along the inclined face of the puller.

8. The plug connector as claimed in claim 7, wherein said puller has a head portion and an intermediate portion disposed between the head portion and the pair of hooks, said head portion defining an indentation for locating the connecting portion of the latch.

9. The plug connector as claimed in claim 7, wherein said latch has a flat latching portion connected with the connecting portion, said pair of claws symmetrically formed at opposite sides of the latching portion, said flat latching portion together with the claws moving from the latching position to the unlatching position via the upward climbing of the connecting portion.

10. The plug connector as claimed in claim 3, wherein said base comprises an upper base and a lower base, the upper base defining an elongated receiving slot at an upper face thereof for insertion of the latching mechanism.

11. The plug connector as claimed in claim 10, wherein said base defines a transversely extending retaining recess in communication with the receiving slot for retaining the shaft of the pusher and the hook portions of the puller.

12. The plug connector as claimed in claim 10, wherein said base has a pair of protruding tabs formed at a front edge of the receiving slot, and wherein said latching portion of the latch defines a pair of receiving holes engagable with the protruding tabs.

13. The plug connector as claimed in claim 10, wherein said base has a transversely extending engaging recess in communication of the receiving slot for rotatably retaining the pivot of the pusher.

14. The plug connector as claimed in claim 10, further comprising a cable electrically connected with the circuit board, and wherein said circuit board is sandwiched between the upper and lower bases.

15. The plug connector as claimed in claim 1, wherein said connecting portion comprises a pair of L-shaped connecting beams.

16. The plug connector as claimed in claim 1, further comprising an EMI gasket attached to a front side of the base.

17. An electrical connector comprising:

a housing having a base thereon;

a latching mechanism assembled to the base, said latching mechanism including:

a pusher located around a rear side of the housing and being moveable in a pivotal manner with regard to the housing and being accessible to press by a user;

a deflectable latch located in front of the pusher, said latch being in a cantilevered manner with a rear fixed end and a claw at a front free end for latching a complementary connector; and a resisting portion engaged with the latch around said rear fixed end; wherein movement of a rear end of said pusher in a first lateral direction due to a force in said first lateral direction results in movement of a front end of the pusher in a second lateral direction opposite to the first lateral direction simultaneously, and successively actuates the resisting portion to move rearward in an axial direction perpendicular to both said first and second lateral directions, thus urging the latch to be deflected outwardly in said second lateral direction for disengagement from the complementary connector.

18. The connector as claimed in claim 17, wherein the resisting portion is formed on a pusher which is linked to a front section of the pusher.

19. The connector as claimed in claim 18, wherein the pusher is retainably engaged with a metallic shell which cooperates with the housing to sandwich said pusher therebetween so as to assure the pusher resumes to an original position when the force is removed.

20. The connector as claimed in claim 19, wherein the puller is retainably engaged with the shell and sandwiched between the shell and the housing so as to assure the puller is resumes to an original position when the force is removed.

* * * * *